US005863357A

United States Patent [19]

Shinomiya et al.

[11] Patent Number: 5,863,357

[45] Date of Patent: Jan. 26, 1999

[54] METHOD FOR ZINC PHOSPHATING MOLDED METAL ARTICLES

[75] Inventors: Mitsuo Shinomiya, Canton, Mich.; Masashi Takahashi, Tokyo, Japan; Satoshi Miyamoto, Toyonaka, Japan; Tamotsu Sobata, Ibaraki, Japan

[73] Assignee: Nippon Paint Co., Ltd., Osaka, Japan

[21] Appl. No.: 833,008

[22] Filed: Apr. 4, 1997

[30] Foreign Application Priority Data

Apr. 10, 1996 [JP] Japan ..... 8-87956

[51] Int. Cl.[6] ..... C23C 8/00

[52] U.S. Cl. ..... 148/241; 118/612; 148/253; 148/261; 148/262

[58] Field of Search ..... 148/241, 253, 148/261, 262; 118/612

[56] References Cited

U.S. PATENT DOCUMENTS 4,529,451 7/1985 Otrhalek et al. ..... 148/241

FOREIGN PATENT DOCUMENTS

| | | |
|---|---|---|
| 114087A | 1/1984 | European Pat. Off. . |
| 315059A | 10/1988 | European Pat. Off. . |
| 695817A | 2/1996 | European Pat. Off. . |
| 779377A | 6/1997 | European Pat. Off. . |
| 2443513A | 7/1980 | France . |
| 3275130 | 12/1991 | Japan . |
| 2021649 | 12/1979 | United Kingdom . |

OTHER PUBLICATIONS

Database WPI, Section Ch, Week 7920, Derwent Publications Ltd., London, GB and JP 54 045 639 A, Nov. 1979.

Patent Abstracts of Japa, vol. 016, No. 086 (C–0916), 3 Mar. 1992.

Galvanotechnik, vol. 76, No. 11, 1 Nov. 1985 & SU 1–070 212 A.

*Primary Examiner*—David A. Simmons
*Assistant Examiner*—Robert R. Koehler
*Attorney, Agent, or Firm*—Townsend & Banta

[57] ABSTRACT

Disclosed is a method for zinc phosphating a molded metal article wherein a treating bath composition comprises from 1.5 to 5.0 g/l of zinc ion, from 0.1 to 3.0 g/l of manganese ion, from 5 to 40 g/l of phosphate ion, from 0.05 to 3.0 g/l of a fluorine compound as HF and hydoxylamine as a chemical conversion accelerator. A concentration of hydroxylamine is maintained to satisfy the following relationship:

$0.5 \leqq [\text{hydroxylamine}](g/l) - 2.0 \times [Fe^{2+}](g/l) \leqq 3.0$ The treating bath is agitated by a vibratory agitating means provided in the treating vessel so that a mean acceleration a of a treating solution present within a bath region in which the molded metal article is immersed to be treated under fluid agitation is at least 8 cm/sec$^2$. The mean acceleration is calculated from the following equation:

$$a = \sqrt{X^2 + Y^2 + Z^2}$$

wherein values of X, Y and Z, each in unit of cm/sec$^2$, indicate average acceleration values of treating solution in three respective X, Y and Z axial directions which are perpendicular to each other. The velocity changes of the treating solution in a flow state in respective X, Y and Z directions are synchronously measured at measuring locations for 60 seconds to be averaged to obtain the respective average acceleration values in X, Y and Z directions.

5 Claims, 6 Drawing Sheets

METHOD FOR ZINC PHOSPHATING MOLDED METAL ARTICLES

BACKGROUND OF THE INVENTION

1. Field of the Invention

The present invention relates to a method for zinc phosphating a molded metal article such as an automobile body, a household electrical appliance, steel furniture and the like.

2. Description of Related Art

In general, zinc phosphating is made to molded metal articles such as automobile bodies, household electric appliances, steel furniture and the like, prior to providing an overlay coating thereon. Spray and dipping methods are typically employed for such zinc phophating. The dipping method is preferably employed when a treated object has a baggy structure as an automobile body does and a higher corrosion resistance must be given to the treated object after the overlay coating is provided. The dipping method involves immersing the molded metal article into a treating bath of a treating solution in a treating tank.

The treating bath for zinc phosphating typically contains phosphate ions, zinc ions and other metal ions. Frequently, the treating solution further incorporates a chemical conversion accelerator for the purpose of accelatating formation of zinc phosphate coating. Examples of suitable chemical conversion accelerators include nitrite ion, hydrogen peroxide and nitrobenzensulfonate ion as has been conventionally used. Of the above, nitrite ion is widely used.

However, enviromental issues are accompanied by the use of nitrites such as sodium nitrite for the chemical conversion accelerator as nitrogen oxides evolve from the treating bath containing the same.

Japanese Patent Laying-open Nos. Sho 64-277 (1989) and Hei 5-195245 (1993) respectively disclose employing a treating bath containing hydroxylamine such as hydroxylamine sulfate for the chemical conversion accelerator. The use of hydroxylamine as the chemical conversion accelerator enables a chemical conversion treatment to be made without unfavorable evolution of nitrogen oxides. Similarly to conventional chemical conversion accelerators, it is also effective to inhibit formation of iron sludges in the treating bath, which advantageously permits a small-scale desludging process.

However, the use of hydroxylamine as the chemical conversion accelerator is not well-suited to treating metal articles having a baggy structure such as an automobile body and the like because it leads to an unsatisfactory formation of a zinc phosphate coating on the baggy structure and imparts poorer corrosion resistance characteristics thereto compared to the other types of chemical conversion accelerators.

Accordingly, it is an object of the present invention is to provide a method for zinc phosphating a molded metal article which is capable of inhibiting formation of nitrogen oxides and iron sludges and of enhancing corrosion resistance characteristics in the baggy structure of the article while solving the aforementioned problems as has been conventionally raised.

SUMMARY OF THE INVENTION

The present invention provides a method for zinc phosphating a molded metal article wherein the article is immersed into a treating bath in a treating tank. A composition of the treating bath comprises from 1.5 to 5.0 g/l of zinc ion, from 0.1 to 3.0 g/l of manganese ion, from 5 to 40 g/l of phosphate ion, from 0.05 to 3.0 g/l of a fluorine compound as HF and hydoxylamine as a chemical conversion accelerator. A concentration of hydroxylamine is maintained to satisfy the following relationship:

$$0.5 \leqq [hydroxylamine](g/l) - 2.0 \times [Fe^{2+}](g/l) \leqq 3.0$$

The treating bath is agitated by a vibratory agitating means provided in the treating vessel so that a mean acceleration a of a treating solution present within a bath region in which the molded metal article is immersed to be treated under fluid agitation is at least 8 cm/sec$^2$. The mean acceleration is calculated from the following equation:

$$a = \sqrt{X^2 + Y^2 + Z^2}$$

where, X, Y and Z, each in unit of cm/sec$^2$, indicate average acceleration values of liquid in three respective directions along X, Y and Z axes which are perpendicular to each other as velocity changes of the liquid in respective X, Y and Z directions are synchronously measured for 60 seconds to provide the respective average acceleration values in X, Y and Z directions.

The treating bath composition for suitable use in the present zinc phosphating treatment, as described above, contains hydroxylamine within a particular concentration range which satisfies the above-defined relationship. The expression "[hydroaxylamine]−2.0×[$Fe^{2+}$]" is hereinafter referred to an effective concentration of hydroxylamine.

As the effective concentration of hydroxylamine falls below 0.5 g/l, reduced hiding or yellow rusting is possibly caused in a zinc phosphate coating formed on a molded metal article, and as a result provides a reduced corrosion resistance to the metal article after the overlay coating is formed thereon. On the other hand, if the effective concentration of hydroxylamine exceeds 3.0 g/l, a further advantageous effect is hardly expected while economical disadvantages become appreciable. $Fe^{2+}$ ions in the treating bath are introduced thereinto by treating the molded metal article having a ferrous metal surface.

Examples of suitable hydroxylamines include hydroxylamine sulfate, hydroxylamine hydrochloride, hydroxylamine nitrate, hydroxylamine phosphate and any mixtures thereof. Of the above, hydroxylamine sulfate (HAS) is preferred which is a stable form of hydroxylamine.

The treating bath may additionally contain another class of chemical conversion accelerator in a permissible range within which effectiveness of hydroxylamine can not be impaired. The another class of chemical conversion accelerator include at least one selected from nitrite, chlorate, hydrogen peroxide, m-nitrobenzene sulfonate and the like.

The treating bath for use in the present zinc phosphating further contains from 1.5 to 5.0 g/l of zinc ion, from 0.1 to 3.0 g/l of manganese ion, from 5 to 40 g/l of phosphate ion and from 0.05 to 3.0 g/l of a fluorine compound as HF.

If the content of zinc ion is below 1.5 g/l, reduced hiding or yellow rusting may be caused in a phosphate coating which possibly results in a reduced corrosion resistance of the metal article after the overlay coating is formed thereon. On the other hand, if the content of zinc ion exceeds 5.0 g/l, coating adhesion to a molded metal article having a zinc-containing metal surface may be disadvantageously reduced. More preferably, the zinc ion content is in the range of 2.0 to 3.0 g/l.

If the content of manganese ion is below 0.1 g/l, the corrosion resistance of a coating on and adhesion of the coating to a molded metal article having a zinc-containing metal surface may be disadvantageously reduced. On the other hand, the manganese ion content of above 3 g/l provides no further effectiveness and poorer process economy. The manganese ion content is more preferably in the range of 0.8 to 2.0 g/l.

The phosphate ion content below 5 g/l possibly causes the bath composition to extensively vary so that a satisfactory zinc phosphate coating may not be stably formed. The phosphate ion content exceeding 40 g/l adds to no further particular effectiveness and simply provides poorer process economy. The phosphate ion content is more preferably in the range of 10 to 20 g/l.

Also, the fluorine compound content below 0.05 g/l as HF possibly causes the bath composition to extensively vary so that a satisfactory zinc phosphate coating may not be stably formed. The fluorine compound content exceeding 3 g/l adds to no further particular effectiveness and brings about poorer process economy. Examples of suitable fluorince compounds include hydrofluoric acid, silicofluoric acid, fluoroboric acid, zirconium hydrofluoric acid, titanium hydrofluoric acid alkaline or ammonium salts thereof and the like. A more prefarble content of fluorine compound ranges from 0.3 to 1.5 g/l as HF.

The treating bath may further contain 2 to 40 g/l of nitrate ion and/or 0.05 to 2 g/l of chlorate ion. It is preferable that the free acidity of the treating bath ranges from 0.5 to 2.0 points. The free acidity of the treating bath can be determined by sampling 10 ml of the treating solution and titrating the sampled solution with 0.1N caustic soda using Bromophenol Blue as an indicator. If the free acidity falls below 0.5 points, stability of the treating bath may be reduced to possibly form sludges. On the other hand, if the free acidity goes beyond 2.0 points, a reduced corrosion resistance may be observed in the SST (salt spray test).

The treating bath may further contain nickel ion. The nickel ion content is preferably in the range of 0.1 to 6.0 g/l, more preferably of 0.1 to 2.0 g/l.

The zinc phosphating method of the present invention employs the above-specified treating bath composition and agitates the treating bath by means of vibratory agitators mounted in the treating vessel so that the above-defined mean acceleration a of the treating solution in a bath region into which a molded metal article is immersed is at least 8 $cm/sec^2$ for zinc phosphating the article under flow agitation.

In accordance with the present invention, the treating bath is agitated by vibratory agitator means mounted in the treating vessel. One example of such vibratory agitator means is a device which includes a vibrating plate mounted in the treating vessel for agitating the treating bath by vibration thereof. As the size of the treating vessel gets larger, two or more of the vibrating plate are preferably employed for vertical arrangement thereof in a row. The shape of the vibrating plate can be selectively adjusted to various sizes of the treating vessel, manners of immersing the treated object or the others. Typically, a vibratory motor is employed to transmit vibration to the vibrating plates.

In accordance with the present invention, zinc phosphating is carried out under agitation by which a mean acceleration a of the treating solution in the bath region into which the treated object is immersed is brought to be at least 8 $cm/sec^2$ . The mean acceleration a is more preferably at least 10 $cm/sec^2$ and still more preferably from 10 to 50 $cm/sec^2$.

As the mean acceleration a falls below the aforementioned value, zinc phosphating a baggy structure in a uniform and excellent manner becomes difficult. On the other hand, as the mean acceleration a goes excessively higher, no further particular effectiveness can not be obtained while it becomes possible that the treating solution splashes or overflows from the treating vessel resulting in an ununiform treatment.

As discussed above, the mean acceleration a can be calculated by measuring changes in flow velocities of the treating solution with respect to time. These flow velocities of the treating solution can be measured by a suitable flowmeter such as a three-dimensional electromagnetic flowmeter which obeys the Faraday's law of electromagnetic induction for its measurement basis. When such a flowmeter is employed, average acceleration values in respective X, Y and Z directions are calculated from the measured X, Y and Z directional components of the flow velocities to obtain a value of the substantially three-dimentinal, mean acceleration a.

The zinc phosphating in accordance with the present invention can be carried out at a temperature as generally employed in the art, for example, at a temperature ranging from 20° C. (room temperature) to 70° C. The time period during which an molded metal article is immersed in the treating bath in the treating vessel is preferably at least 10 seconds, more preferably at least 30 seconds, still more preferably from 1 to 2 minutes.

DESCRIPTION OF THE PREFERRED EMBODIMENTS

Figure 1:
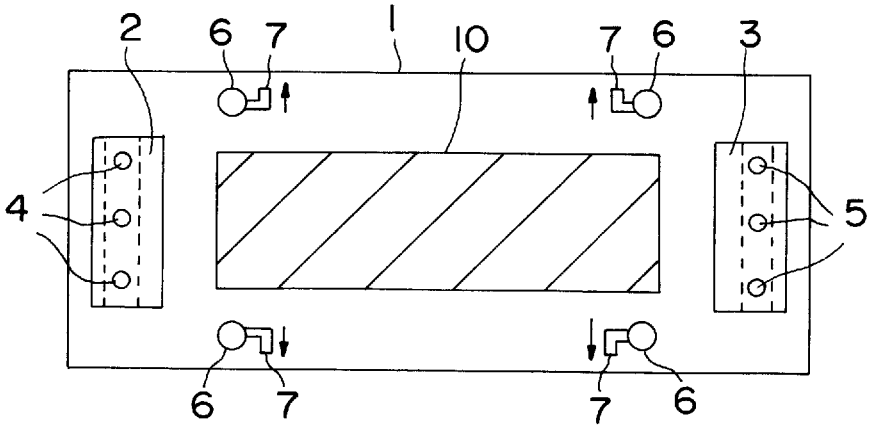
FIG. 1 is a plan view illustrating a treating tank as employed in an embodiment of the present invention.
Figure 2:
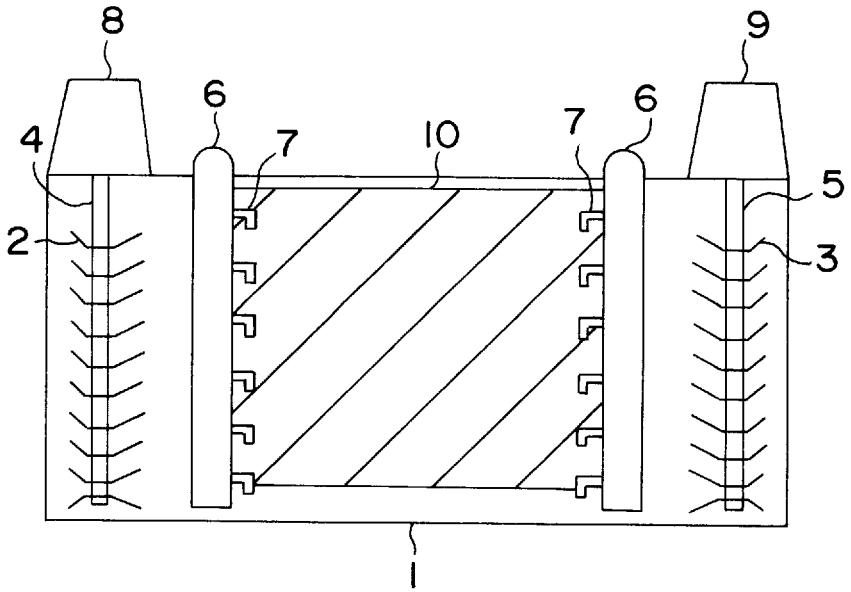
FIG. 2 is a side sectional view of the treating tank as illustrated in FIG. 1.

FIG. 1 and FIG. 2 illustrate a treating vessel 1 as employed in one embodiment of a method for zinc phosphating a molded metal article in accordance with the present invention. FIGS. 1 and 2 are a plan view and a side sectional view of the treating vessel 1, respectively. The treating vessel 1 is 1000 mm in width, 1650 mm in height and 2300 mm in length.

As illustrated in FIGS. 1 and 2, the treating vessel 1 in accordance with one embodiment of the present invention has at its opposite longitudinal ends vibratory agitating devices 8, 9 as vibratory agitating means. The vibratory agitating devices 8, 9 act to agitate a treating bath of a treating solution in the treating vessel 1 by vibrating plates 2, 3 mounted to vibrating rods 4, 5 in the treating vessel 1. In the present embodiment, twenty three vibrating plates are mounted to each of the vibrating rods 4, 5 at regular intervals of 50 mm.

The treating tank vessel 1 further has pump agitating risers 6 for agitating the treating bath by pump agitation. The pump agitating risers 6 are disposed at four locations in the treating vessel 1 to surround or define a bath region 10 into which a treated object is immersed. As illustrated in FIGS. 1 and 2, each of the pump agitating risers 6 incorporates a plurality of discharge pipes 7 through which a treating solution as supplied from respective pump agitating riser 6 is discharged toward a wall surface of the treating vessel 1. Such pump agitating risers 6 are disposed for comparative purposes.

Figure 5:
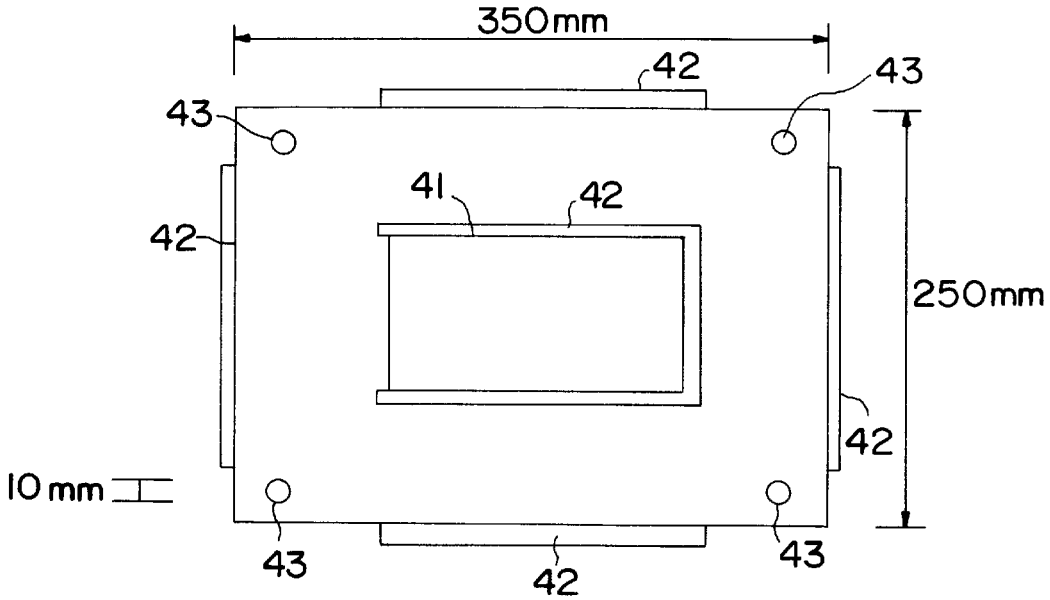
FIG. 5 is a plan view illustrating holders for holding the test pieces as employed in an embodiment of the present invention.
Figure 6:
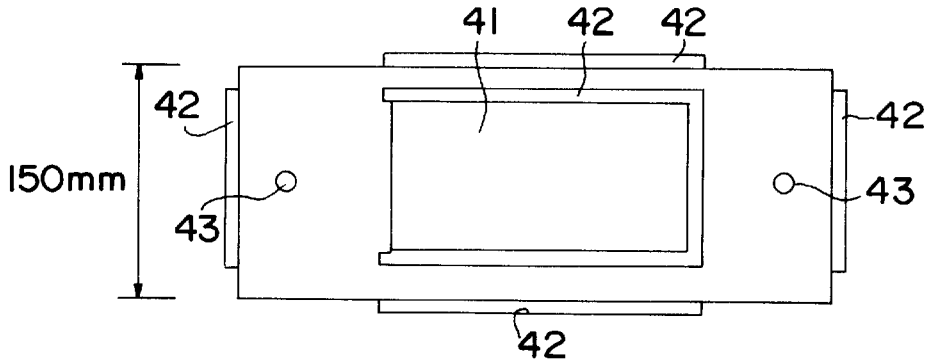
FIG. 6 is a front view illustrating the holders for holding the test pieces.
Figure 7:
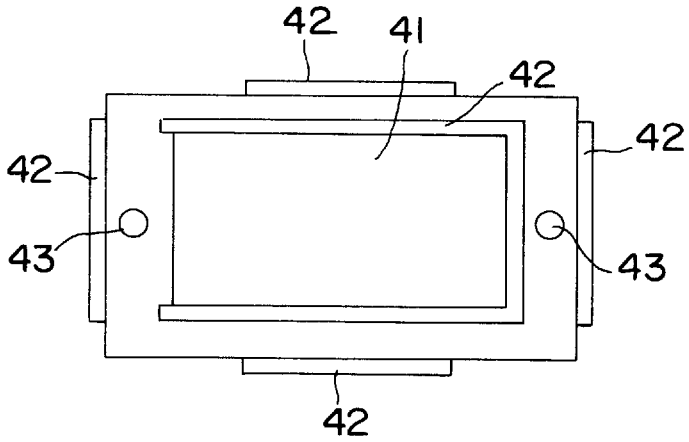
FIG. 7 is a side view illustrating the holders for holding the test pieces.

Zinc phosphating was carried out using the treating tank as illustrated in FIGS. 1 and 2. As a test piece, a cold rolled steel plate (SPC) of 70×150×0.8 mm was used which had been washed with alkali to treat its surface. These test pieces were placed on respective surfaces of a regular-hexahedral holder as shown in FIGS. 5 through 7. The holders were immersed into the treating bath so that each holder was positioned at respictive one of nine locations A through I in the immersion region 10 into which the object to be treated was immersed. Accordingly, six test pieces were immersed and placed at each of the immersion locations A through I.

FIGS. 5 through 7 are a plan view, a front view and a side view of the holder, respectively. As illustrated in FIGS. 5 through 7, a central portion of each holder surface has an opening 41 along which a frame 42 is mounted. The test piece is held by this frame 42. Each holder surface has a peripheral portion at which circular holes 43 of 10 mm in diameter are provided to pass the treating solution therethrough toward inside of the holder 42 so that an inner surface of the holder can be contacted with the treating solution. Accordingly, the inner surface of the holder can be also treated.

Three types of treating baths for zinc phosphating were prepared which had compositions different from each other; a treating bath A, a comparative treating bath B and a comparative treating bath C respectively, as shown in Table 1.

TABLE 1

| | Treating Bath A | Comparative Treating Bath B | Comparative Treating Bath C |
|---|---|---|---|
| $Zn^{2+}$ (g/l) | 2.0 | 2.0 | 2.0 |
| $Ni^{2+}$ (g/l) | 1.0 | 1.0 | 1.0 |
| $Mn^{2+}$ (g/l) | 0.7 | 0.7 | 0.7 |
| $PO_4^{3-}$ (g/l) | 15.0 | 15.0 | 15.0 |
| $NO_3^-$ (g/l) | 3.0 | 3.0 | 3.0 |
| $SiF_6^{2-}$ (g/l) (as HF) | 1.0 | 1.0 | 1.0 |
| $Fe^{2+}$ (g/l) | 0.05 | 1.2 | 0 |

TABLE 1-continued

| | Treating Bath A | Comparative Treating Bath B | Comparative Treating Bath C |
|---|---|---|---|
| Chemical Conversion Accelerator | HAS | HAS | $NO_2^-$ |
| (g/l) | 2.5 | 2.5 | 0.1 |
| Free Acidity (point) | 0.6 | 0.6 | 0.6 |
| Temperature (°C.) | 40 | 40 | 40 |

The treating bath A in Table 1 has a composition which falls within the scope of this invention. The effective hydroxylamine content in the comparative treating bath B falls below the intended range thereof for the present invention. The comparative treating bath C contains sodium nitrite as an chemical conversion accelerator.

EXAMPLE 1

Zinc phosphating was carried out using the treating bath A. The treating bath A in the treating vessel was agitated by means of a vibratory agitating device to obtain mean accelerations of the treating solution as shown in Table 2.

EXAMPLE 2

Zinc phosphating was carried out using the treating bath A. The treating bath A in the treating vessel was agitated by means of the vibratory agitating device to obtain mean accelerations of the treating solution as shown in Table 2.

COMPARATIVE EXAMPLE 1

Zinc phosphating was carried out using the treating bath A. The treating bath A in the treating vessel was agitated by means of the vibratory agitating device to obtain mean accelerations of the treating solution as shown in Table 3.

COMPARATIVE EXAMPLE 2

Zinc phosphating was carried out using the treating bath A. The treating bath A in the treating vessel was agitated by means of the vibratory agitating device to obtain mean accelerations of the treating solution as shown in Table 3.

COMPARATIVE EXAMPLE 3

Zinc phosphating was carried out using the comparative treating bath B. The treating bath B in the treating vessel was agitated by means of the vibratory agitating device to obtain mean accelerations of the treating solution as similar to those of Example 1.

COMPARATIVE EXAMPLE 4

Zinc phosphating was carried out using the comparative treating bath C. The treating bath C in the treating vessel was agitated by means of the vibratory agitating device to obtain mean accelerations of the treating solution as similar to those of Example 1.

[Agitating Conditions]

The agitating conditions as respectively employed in the above Examples 1 and 2 as well as Comparative Examples 1 through 4 were determined by the following procedures.

Figure 3:
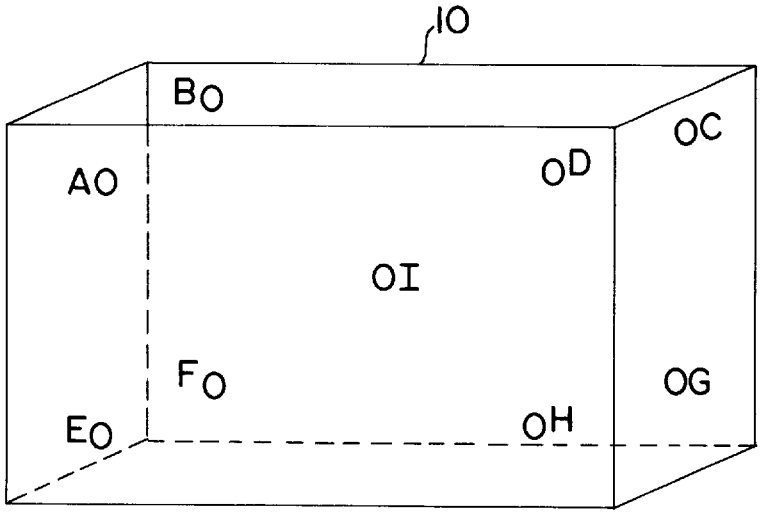
FIG. 3 is a perspective view illustrating locations of test pieces which are respectively immersed and placed in a treating bath region for a treated object and spots for measuring mean accelerations.
Figure 4:
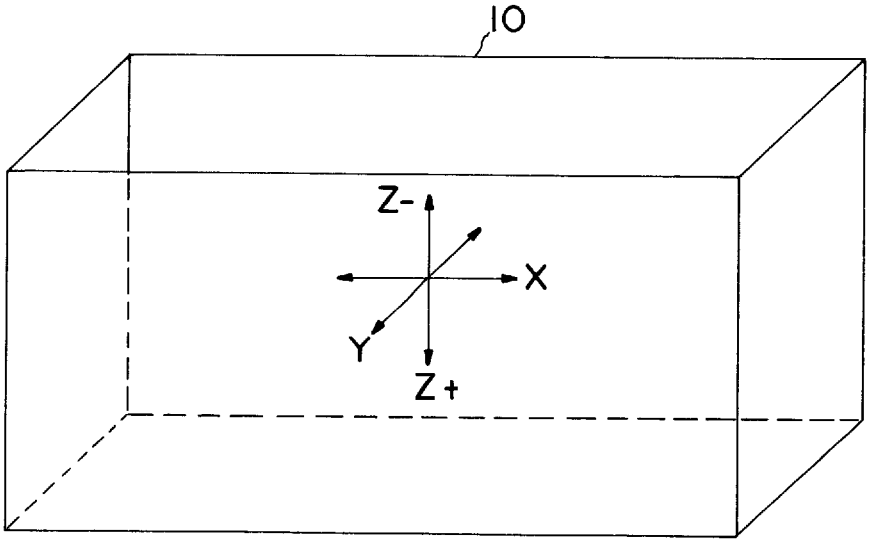
FIG. 4 is a perspective view illustrating X, Y and Z directions in which respective flow velocities of the treating solution are measured in the treating bath region for a treated object.

Prior to immersion of test pieces into each treating bath, the agitating conditions of the treating bath were adjusted as similar to that for use in zinc phosphating. Flow velocities and changes in flow velocity were measured at respective locations A through I as shown in FIG. 3. A three-dimensional electromagnetic flowmeter (trade designation "ACM300-A"; manufactured by Alec Electronics Co., Ltd.) was employed to measure those values in respective X, Y and Z directions as shown in FIG. 4. Thus, X, Y and Z directions were respectively determined to be in conformity with length, width and height directions of the treating vessel. Further, the Z direction toward a bottom of the treating vessel was referred to a $Z^+$ direction while the Z direction toward a top surface of the treating bath was referred to $Z^-$ direction.

Figure 8:
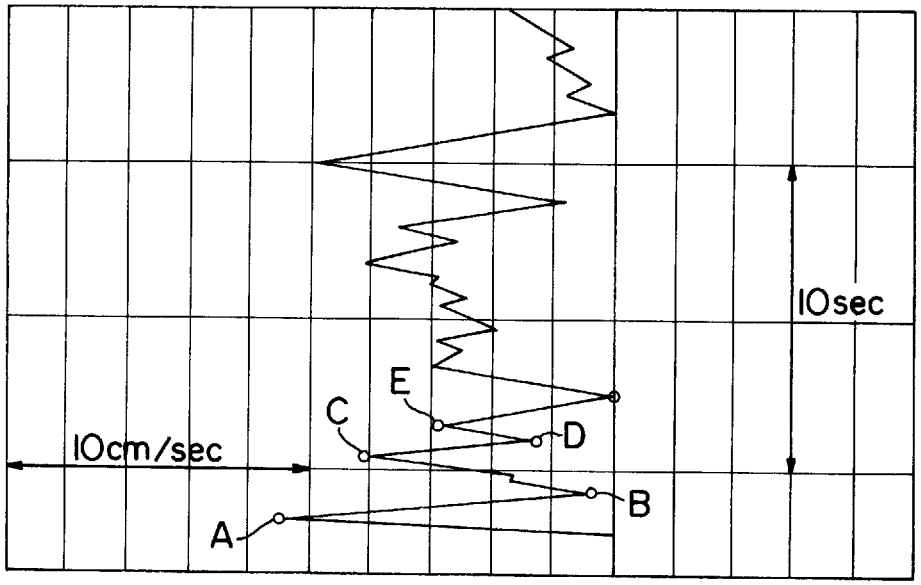
FIG. 8 is a diagram which depicts charting velocity values.

At each measurement sites, flow velocities in X, Y and directions were respectively measured at regular time intervals of 0.5 second. Acceleration values were calculated from a recording chart of the flow velocities. FIG. 8 shows one example of the recording chart of flow velocities. Time durations and changes in flow velocity between two consecutive peaks on the recording chart were measured to calculate acceleration values by dividing the flow velocity change by the time duration. In FIG. 8, flow velocity changes and time durations were measured between two consecutive peaks A and B, B and C, C and D, and D and E respectively to calculate acceleration values. The acceleration values thus taken for a time period of 60 seconds were averaged to obtain the average acceleration value.

The average acceleration values in X, Y and Z directions were calculated in the aforementioned manner, and these average values were inserted into the above equation to obtain a mean acceleration value a of a three-dimensional flow.

[Evaluation of Chemical Conversion Characteristics]

The chemical conversion coatings on the test pieces which had been zinc phosphated at respective measuring locations A through I were observed with a naked eye as well as by means of an optical microscope. A rating of ⓪ indicates that all of the six test pieces had uniform and dense chemical conversion coatings thereon. A rating of ○ indicates that chemical conversion coatings on the six test pieces were all satisfactory and no defectives thereof were found such as reduced hiding or yellow rusting. A rating of Δ indicates that at least one of the six test pieces had a ununiform chemical conversion coating thereon due to its inclusion of sludges. A rating of X indicates that reduced hiding or yellow rusting was observed in a chemical conversion coating on at least one of the six test pieces. Tables 2 through 4 show the results of the observed chemical conversion characteristics at respective measuring locations A through I.

[Evaluation of Corrosion Resistance Characteristics]

Acrylic type coating composition (product name "Super Luck"; manufactured by Nippon Paint Co., Ltd.) was applied to each of the test pieces previously subjected to respective chemical conversion treatment as discussed above so that the dry film thickness of the coating thereon was adjusted to be about 25 μm. Each of the coated test pieces was subjected to the following combined corrosion cycle test.

Combined Corrosion Cycle Test: Crosscut was made through a coating on a test piece which was subsequently subjected to test loads of 70 cycles by a combined corrosion cycle test equipment under the following corrosion test conditions. A maximum lenght of corrosion which progressed in a planar direction from a crosscut intersection was measured.

Corrosion Test Conditions: Salt spraying (in accordance with JIS-Z-2371); 4 hours→Drying (60° C.×2 hours) →Wetting (50° C. 95% RH or higher; 2 hours)

TABLE 2

| Measuring Location in Treating Vessel | Example 1 (Treating Bath A) Mean Acceleration (cm/sec²) X | Y | Z | a | Chemical Conversion Characteristics (*1) | Corrosion Resistance Characteristics (*1) | Example 2 (Treating Bath A) Mean Acceleration (cm/sec²) X | Y | Z | a | Chemical Conversion Characteristics (*1) | Corrosion Resistance Characteristics (*1) |
|---|---|---|---|---|---|---|---|---|---|---|---|---|
| A | 9.1 | 8.2 | 7.7 | 14.5 | ⓪/⓪ | 1.1/1.3 | 7.5 | 4.2 | 5.4 | 10.2 | ⓪/⓪ | 1.2/1.3 |
| B | 9.3 | 8.1 | 7.9 | 14.6 | ⓪/⓪ | 1.0/1.2 | 7.6 | 4.3 | 5.2 | 10.2 | ⓪/⓪ | 1.0/1.3 |
| C | 9.0 | 8.0 | 7.4 | 14.1 | ⓪/⓪ | 1.1/1.3 | 7.8 | 4.5 | 5.1 | 10.3 | ⓪/⓪ | 1.1/1.2 |
| D | 9.2 | 8.2 | 7.7 | 14.5 | ⓪/⓪ | 1.2/1.1 | 7.4 | 4.4 | 5.3 | 10.1 | ⓪/⓪ | 1.2/1.3 |
| E | 8.6 | 7.9 | 7.7 | 14.0 | ⓪/⓪ | 1.0/1.0 | 7.3 | 3.2 | 3.1 | 8.6 | ⓪/○ | 1.2/1.6 |
| F | 8.8 | 7.5 | 7.9 | 14.0 | ⓪/⓪ | 1.2/1.2 | 7.3 | 3.3 | 3.2 | 8.6 | ⓪/○ | 1.1/1.8 |
| G | 8.6 | 7.7 | 7.4 | 13.7 | ⓪/⓪ | 1.1/1.0 | 7.3 | 3.1 | 3.4 | 8.6 | ⓪/○ | 1.2/1.7 |
| H | 8.9 | 7.7 | 7.7 | 14.1 | ⓪/⓪ | 1.2/1.1 | 7.0 | 3.4 | 3.2 | 8.4 | ⓪/○ | 1.1/1.8 |
| I | 8.9 | 7.9 | 8.2 | 14.5 | ⓪/⓪ | 1.0/1.2 | 7.1 | 4.1 | 3.4 | 8.9 | ⓪/○ | 1.0/1.9 |

*1: Outer Surface/Inner Surface

TABLE 3

| Measuring Location in Treating Vessel | Comparative Example 1 (Treating Bath A) Mean Acceleration (cm/sec$^2$) X | Y | Z | a | Chemical Conversion Characteristics (*1) | Corrosion Resistance Characteristics (*1) | Comparative Example 2 (Treating Bath A) Mean Acceleration (cm/sec$^2$) X | Y | Z | a | Chemical Conversion Characteristics (*1) | Corrosion Resistance Characteristics (*1) |
|---|---|---|---|---|---|---|---|---|---|---|---|---|
| A | 4.9 | 3.0 | 4.1 | 7.1 | ○/X | 1.5/4.0 | 2.7 | 3.2 | 1.6 | 4.5 | ○/X | 3.0/5.1 |
| B | 4.8 | 3.2 | 3.9 | 7.0 | ○/X | 1.5/4.5 | 3.0 | 2.9 | 1.6 | 4.5 | ○/X | 3.5/5.4 |
| C | 5.0 | 2.9 | 4.2 | 7.1 | ○/X | 1.8/4.5 | 3.0 | 2.9 | 1.5 | 4.4 | ○/X | 3.0/4.9 |
| D | 4.9 | 2.9 | 4.0 | 7.0 | ○/X | 1.8/4.5 | 3.1 | 2.9 | 1.6 | 4.5 | ○/X | 3.5/5.0 |
| E | 3.9 | 3.1 | 2.1 | 5.4 | ○/X | 2.0/5.0 | 2.8 | 3.0 | 3.1 | 5.1 | ○/X | 2.0/4.5 |
| F | 4.0 | 3.1 | 2.3 | 5.6 | ○/X | 2.0/5.0 | 2.8 | 3.0 | 3.2 | 5.2 | ○/X | 2.2/4.8 |
| G | 4.1 | 2.9 | 2.5 | 5.4 | ○/X | 2.0/4.8 | 2.9 | 3.0 | 3.2 | 5.3 | ○/X | 2.0/4.5 |
| H | 4.0 | 3.0 | 2.3 | 5.5 | ○/X | 2.0/5.2 | 2.8 | 2.9 | 3.3 | 5.2 | ○/X | 2.2/4.5 |
| I | 3.0 | 2.5 | 2.3 | 4.5 | ○/X | 3.0/6.0 | 2.9 | 3.1 | 3.0 | 5.2 | ○/X | 2.0/4.5 |

*1: Outer Surface/Inner Surface

TABLE 4

| Measuring Location in Treating Vessel | Comparative Example 3 (Comparative Treating Bath B) Mean Acceleration (cm/sec$^2$) X | Y | Z | a | Chemical Conversion Characteristics (*1) | Corrosion Resistance Characteristics (*1) | Comparative Example 4 (Comparative Treating Bath C) Mean Acceleration (cm/sec$^2$) X | Y | Z | a | Chemical Conversion Characteristics (*1) | Corrosion Resistance Characteristics (*1) |
|---|---|---|---|---|---|---|---|---|---|---|---|---|
| A | 9.2 | 8.3 | 7.7 | 14.6 | X/X | 5.3/6.5 | 7.4 | 4.3 | 5.2 | 10.0 | ◎/Δ | 1.2/1.7 |
| B | 9.1 | 8.0 | 7.8 | 14.4 | X/X | 5.5/7.0 | 7.6 | 4.1 | 5.1 | 10.0 | ◎/Δ | 1.0/1.7 |
| C | 9.0 | 8.2 | 7.5 | 14.3 | X/X | 5.6/7.1 | 7.7 | 4.5 | 4.9 | 10.2 | ◎/Δ | 1.1/1.6 |
| D | 9.1 | 8.1 | 7.8 | 14.5 | X/X | 5.3/7.0 | 7.4 | 4.3 | 5.2 | 10.0 | ◎/Δ | 1.2/1.7 |
| E | 8.5 | 7.5 | 7.4 | 13.5 | X/X | 4.7/6.5 | 7.3 | 3.2 | 3.1 | 8.6 | ◎/Δ | 1.2/2.5 |
| F | 8.1 | 7.2 | 7.5 | 13.2 | X/X | 4.8/6.8 | 7.2 | 3.1 | 3.2 | 8.5 | ◎/Δ | 1.4/2.2 |
| G | 8.4 | 7.6 | 7.8 | 13.8 | X/X | 5.3/7.5 | 7.1 | 3.2 | 3.3 | 8.5 | ◎/Δ | 1.2/2.3 |
| H | 8.9 | 7.5 | 7.5 | 13.8 | X/X | 5.4/7.2 | 7.2 | 3.4 | 3.1 | 8.5 | ◎/Δ | 1.3/2.5 |
| I | 8.9 | 8.0 | 8.1 | 14.5 | X/X | 5.1/6.5 | 7.0 | 4.2 | 3.4 | 8.8 | ◎/Δ | 1.5/2.2 |

*1: Outer Surface/Inner Surface

As apparent from the results in Table 2, the present zinc phosphating process in which the treating bath containg a predetermined amount of hydroxylamine is subjected to flow agitation at a mean acceleration a of at least 8 cm/sec$^2$ is capable of forming satisfactory chemical conversion coatings. It also enables formation of highly corrosion-resistant coatings even on a baggy structure.

It should be understood from the comparison between the results of Comparative Examples 1 and 2 that inadequate agitating conditions prevent the process from forming coatings of excellent corrosion resistance on the baggy structure.

The results of Comparative Example 3 demonstrate that the treating bath having an effective hydroxylamine concentration below the intended concentration range for the present invention is unable to form satisfactory chemical conversion coatings and to provide good corrosion resistance thereof. The results of Comparative Example 4 further demonstrate that the use of sodium nitrite as a chemical conversion accelerator accompanies formation of an appreciable amount of ferrous sludges in the course of the zinc phosphating process. The inclusion of the ferrous sludges in the resulting coatings causes ununiform appearance of the coatings.

During the chemical conversion treatments, the concentration of nitrogen oxides was measured in the working atmosphere. Nitrogen oxides were not detected in Examples 1 and 2 as well as in Comparative Examples 1 through 3. Nitrogen oxides were detected in Comparative Example 4.

From the foregoings, it should be appreciated that the present invention is capable of inhibiting formation of ferrous sludges and nitrogen oxides, forming good chemical conversion coatings even on a baggy structure and of forming highly corrosion-resistant coatings.

Figure 9:
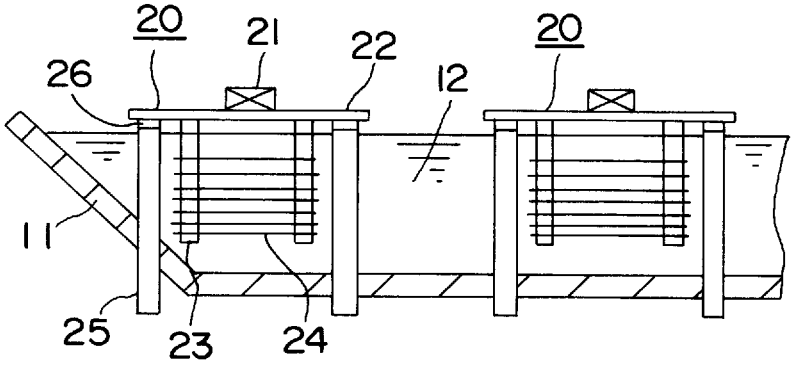
FIG. 9 is a side view which shows a treating vessel as employed in an embodiment of the present invention.
Figure 10:
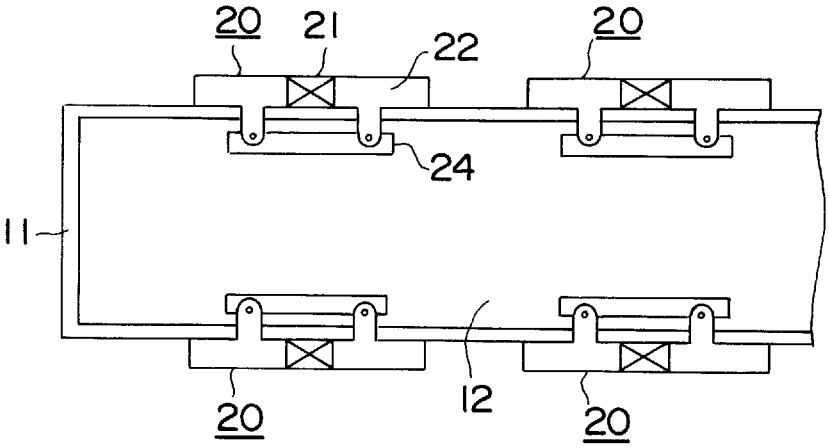
FIG. 10 is a plan view of the treating vessel as employed in the embodiment of the present invention.

FIGS. 9 and 10 are respectively a side view and a plan view, illustrating an entrance portion of the treating vessel for zinc phosphating a molded metal article such as an automobile body and the like in accordance with the present invention. As illustrated in FIGS. 9 and 10, the entrance portion of the boat-shaped treating vessel 11 has two pairs of laterally-facing vibratory agitators 20 mounted to lateral sides of the treating vessel 11 so that the two pairs are longitudinally arranged in two stages. Accordingly, the entrance portion has four vibratory agitators 20 in total. Each of the vibratory agitators 20 has a plurality of vibrating plates 24 to be immersed into the treating bath in the treating vessel 11. Each of the vibrating plates is at its opposite end portions supported by a vibrating rod 23. An upper portion of the vibrating rod 23 is attached to a vibrating frame 22. The vibrating frame 22 is disposed to extend outwardly from the lateral end of the treating vessel 11 and has opposite sides which is placed on supports 25 through springs 26. The portion of the vibrating frame 22 extending outwardly from the lateral end of the treating vessel 11 has on its center a vibratory motor 21.

Vibration generated by the vibratory motor 21 is transmitted to the vibrating frame 22 and through the vibrating rod 23 to the vibrating plates 24 for vibration thereof. The vibrating plates 24 vibrates to agitate the zinc phosphating bath 12 stored in the treating vessel 11 in accodance with the present invention.

Figure 11:
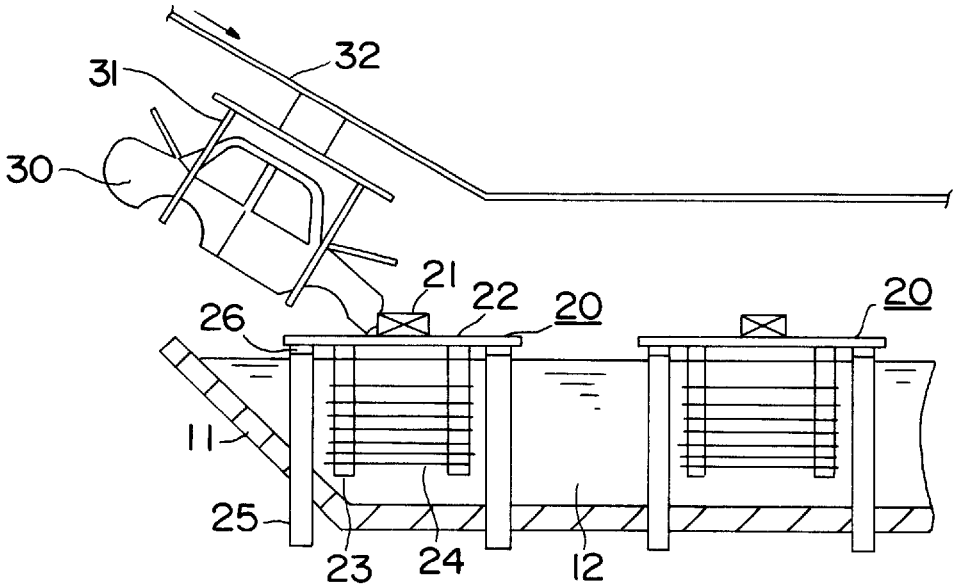
FIG. 11 is a side view which shows an automobile body as a treated object to be immersed into the treating bath in the treating vessel.
Figure 12:
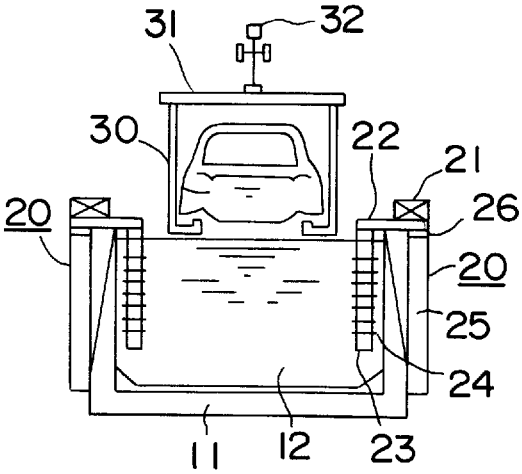
FIG. 12 is a front view which shows the automobile body as a treated object to be immersed into the treating bath in the treating vessel.

FIGS. 11 and 12 are respectively a side view and a front view, illustrating an automobile body as a treated object which is conveyed and immersed into the zinc phosphating bath 12 in the treating vessel 11.

As shown in FIGS. 11 and 12, the zinc phosphating method in accordance with the present invention includes agitating the zinc phosphating bath 12 in the treating vessel 11 by means of the vibrating agitators 20 mounted therein so that a mean acceleration a of the treating solution 12 present within the bath region into which the automobile body 30 is immersed is at least 8 cm/sec$^2$ in its flow state for zinc phosphating the automobile body 30. The automobile body 30 is allowed to stay immersed in the zinc phosphating bath 12 for at least 30 seconds, in general.

In accordance with the present invention, vibrational characteristics of the vibrating plates such as numbers, amplitudes and the others of vibration are controllably adjusted so that a mean acceleration a of the zinc phosphating solution 12 present within the bath region into which the automobile body 30 is immersed is at least 8 cm/sec$^2$ in its flow state. The shapes, sizes and the others of the vibrating plate may be further adjusted.

What is claimed is:

1. A method for zinc phosphating a molded metal article comprising the steps of:

immersing the molded metal article in a treating bath in a treating vessel, wherein a composition of said treating bath comprises from 1.5 to 5.0 g/l of zinc ion, from 0.1 to 3.0 g/l of manganese ion, from 5 to 40 g/l of phosphate ion, from 0.05 to 3.0 g/l of a fluorine compound as HF and hydroxylamine as a chemical conversion accelerator, a concentration of said hydroxylamine being maintained to satisfy the following relationship:

$0.5 \leqq [\text{hydroxylamine}](g/l) - 2.0 \times [Fe^{2+}](g/l)) \leqq 3.0$, and wherein the treating bath is agitated by vibration of a plurality of vibrating plates of a vibratory agitating means provided in the treating vessel so that a mean acceleration a of a treating solution present within a bath region in which the molded metal article is immersed to be treated under fluid agitation is at least 8 cm/sec$^2$, said mean acceleration being calculated from the following equation:

$$a = \sqrt{X^2 + Y^2 + Z^2}$$

wherein: values of X, Y and Z, each in unit of cm/sec$^2$, indicate average acceleration values of treating solution in three respective X, Y and Z axial directions which are perpendicular to each other as the velocity changes of the treating solution in a flow state in respective X, Y and Z directions are synchronously measured at measuring locations for 60 seconds to be averaged to obtain the respective average acceleration values in X, Y and Z directions;

zinc phosphating the molded metal article in said treating bath; and removing the molded metal article from said treating bath.

2. The method for zinc phosphating a molded metal article in accordance with claim 1, wherein said zinc phosphating is carried out under flow agitation so that the means acceleration a is maintained in a range of 10 to 50 cm/sec$^2$.

3. The method for zinc phosphating a molded metal article in accordance with claim 1, wherein said molded metal article is immersed in the treating bath in the treating vessel for duration of at least 10 seconds for zinc phosphating treatment thereof.

4. A method for zinc phosphating a molded metal article comprising the steps of:

immersing the molded metal article into a treating bath in a treating vessel in the course of conveyance thereof across the treating vessel, wherein a composition of said treating bath comprises from 1.5 to 5.0 g/l of zinc ion, from 0.1 to 3.0 g/l of manganese ion, from 5 to 40 g/l of phosphate ion, from 0.05 to 3.0 g/l of a fluorine compound as HF and hydroxylamine as a chemical conversion accelerator, a concentration of said hydroxylamine being maintained to satisfy the following relationship:

$0.5 \leqq [\text{hydroxylamine}](g/l) - 2.0 \times [Fe^{2+}](g/l) \leqq 3.0$, wherein a vibratory agitating means is provided in an entrance portion of the treating vessel, and a treating bath portion present in the entrance portion of the treating vessel is agitated by vibration of a plurality of vibrating plates of said vibratory agitating means so that a mean acceleration a of a treating solution of said bath portion under flow agitation in the entrance portion is at least 8 cm/sec$^2$, said mean acceleration being calculated from the following equation:

$$a = \sqrt{X^2 + Y^2 + Z^2}$$

wherein: values of X, Y and Z, each in unit of cm/sec$^2$, indicate average acceleration values of treating solution in three respective X, Y and Z axial directions which are perpendicular to each other as the velocity changes of the treating solution in a flow state in respective X, Y and Z directions are synchronously measured at measuring locations for 60 seconds to be averaged to obtain the respective average acceleration values in X, Y and Z directions;

zinc phosphating the molded metal article in said treating bath; and removing said molded metal article from said treating bath.

5. The method for zinc phosphating an molded metal article in accordance with claim 4, wherein said molded metal article is immersed in the said treating bath portion in said treating vessel entrance porion for duration of at least 30 seconds.

* * * * *